US008991517B2

(12) United States Patent
Sugiyama et al.

(10) Patent No.: US 8,991,517 B2
(45) Date of Patent: Mar. 31, 2015

(54) REACTION FORCE CUSHIONING MECHANISM FOR AN IMPACT TOOL

(75) Inventors: Yoshio Sugiyama, Anjo (JP); Hikaru Kamegai, Anjo (JP); Masanori Furusawa, Anjo (JP)

(73) Assignee: Makita Corporation, Aichi (JP)

( * ) Notice: Subject to any disclaimer, the term of this patent is extended or adjusted under 35 U.S.C. 154(b) by 916 days.

(21) Appl. No.: 13/191,866

(22) Filed: Jul. 27, 2011

(65) Prior Publication Data

US 2012/0024555 A1 Feb. 2, 2012

(30) Foreign Application Priority Data

Aug. 2, 2010 (JP) ..... 2010-173845

(51) Int. Cl.
*B25D 17/24* (2006.01)
*B25D 17/06* (2006.01)

(52) U.S. Cl.
CPC ..... *B25D 17/24* (2013.01); *B25D 17/06* (2013.01); *B25D 2222/57* (2013.01); *B25D 2250/035* (2013.01); *B25D 2250/245* (2013.01); *B25D 2250/371* (2013.01)
USPC ..... 173/211; 173/162.2; 173/170

(58) Field of Classification Search
CPC ..... B25D 17/06; B25D 2217/0092
USPC ..... 173/211, 162.2, 170
See application file for complete search history.

(56) References Cited

U.S. PATENT DOCUMENTS

| | | | | | |
|---|---|---|---|---|---|
| 2,875,731 | A * | 3/1959 | Settles et al. | ..... | 267/137 |
| 3,788,404 | A * | 1/1974 | Koudelka et al. | ..... | 173/211 |
| 5,975,217 | A * | 11/1999 | Frenzel et al. | ..... | 173/201 |
| 2008/0283264 | A1 * | 11/2008 | Ikuta et al. | ..... | 173/211 |
| 2008/0283265 | A1 | 11/2008 | Ikuta | | |

FOREIGN PATENT DOCUMENTS

| | | |
|---|---|---|
| JP | A-2008-194762 | 8/2008 |
| JP | A-2008-279587 | 11/2008 |

OTHER PUBLICATIONS

Nov. 21, 2011 Extended Search Report issued in European Patent Application No. 11175973.4.

* cited by examiner

*Primary Examiner* — Michelle Lopez
(74) *Attorney, Agent, or Firm* — Oliff PLC

(57) ABSTRACT

An impact tool includes a reaction force transmitting member, a first elastic member that biases the transmitting member forward, and a second elastic member that is pushed by the transmitting member and compressively deforms when the transmitting member moves rearward by receiving a striking reaction force caused when a tool bit strikes a workpiece, thereby cushioning the force. When the tool bit is pressed against the workpiece, the transmitting member is pushed by the tool bit and compresses the first elastic member, and comes in contact with the second elastic member in an uncompressed state, so that the transmitting member is placed in a predetermined working position in the longitudinal direction. When the transmitting member receives the striking reaction force in the working position, the transmitting member moves rearward in the axial direction of the tool bit and compressively deforms the second elastic member, thereby cushioning the striking reaction force.

6 Claims, 4 Drawing Sheets

REACTION FORCE CUSHIONING MECHANISM FOR AN IMPACT TOOL

BACKGROUND OF THE INVENTION

1. Field of the Invention

The invention relates to an impact tool for performing a linear hammering operation on a workpiece, and more particularly to a technique for cushioning a reaction force during hammering operation.

2. Description of the Related Art

Hammering operation by an impact tool is performed with a hammer bit being pressed against a workpiece by application of user's forward pressing force to a tool body. At this time, the hammer bit is pushed to the tool body side (rearward) and an impact bolt is retracted together with the hammer bit and comes in contact with a tool body side component.

By such contact, the tool body is positioned with respect to the workpiece. In this state, when the hammer bit performs a striking movement, the hammer bit is caused to rebound by receiving a reaction force from the workpiece and the reaction force is transmitted to the tool body. Therefore, a reaction force cushioning mechanism for cushioning the striking reaction force is provided in prior art impact tools. For example, Japanese non-examined laid-open Patent Publication No. 2008-279587 discloses such an impact tool.

In the known impact tool, however, further improvement is desired to realize size reduction.

SUMMARY OF THE INVENTION

Accordingly, it is an object of the invention to provide an effective technique for realizing size reduction while providing an effect of cushioning a striking reaction force caused during operation, in an impact tool.

In order to solve the above-described problem, in a preferred embodiment according to the invention, an impact tool performs a predetermined operation on a workpiece at least by an axial linear movement of a tool bit which is mounted in a front end region of a tool body. The impact tool includes a reaction force transmitting member, a first elastic member and a second elastic member. The reaction force transmitting member is arranged to be movable in an axial direction of the tool bit and moves rearward by receiving a striking reaction force which is caused when the tool bit strikes the workpiece. The first elastic member biases the reaction force transmitting member forward. The second elastic member is pushed by the reaction force transmitting member and compressively deforms, thereby cushioning the striking reaction force, when the reaction force transmitting member moves rearward by receiving the striking reaction force. The "predetermined operation" in this invention suitably includes not only a hammering operation in which the tool bit performs only striking movement in its axial direction, but a hammer drill operation in which it performs striking movement in its axial direction and a rotation around its axis, The "first and second elastic members" in this invention typically comprise a compression coil spring, but suitably include rubber.

According to the preferred embodiment of the invention, an initial load of the first elastic member is set to be smaller than an initial load of the second elastic member. In operation, when a user presses the tool bit against the workpiece, the reaction force transmitting member is pushed by the tool bit and compresses the first elastic member, while it comes in contact with the second elastic member in an incompressible state, so that it is placed in a predetermined working position in the longitudinal direction. When the reaction force transmitting member receives the striking reaction force in the working position, the reaction force transmitting member moves rearward in the axial direction of the tool bit and compressively deforms the second elastic member, thereby cushioning the striking reaction force. The first and second elastic members are arranged in tandem in the axial direction of the tool bit. The "initial load" here refers to a load which is applied to the first and second elastic members in the direction of compression in advance and under which the elastic members are mounted. In this case, the initial load of the second elastic member is set to be larger than the user's normal pressing force of pressing the tool bit against the workpiece.

According to this invention, in prior to operation, when the tool bit is pressed against the workpiece and moved rearward, the reaction force transmitting member is pushed by the tool bit and compresses the first elastic member, and also comes in contact with the second elastic member in an incompressible state, so that the reaction force transmitting member is placed in a predetermined working position in the longitudinal direction. Thus, the tool body is positioned with respect to the workpiece. In this state, when the tool bit strikes the workpiece and receives the reaction force, the striking reaction force is transmitted from the tool bit to the reaction force transmitting member and the reaction force transmitting member is moved rearward. When moved rearward, the reaction force transmitting member pushes the second elastic member and compressively deforms it. As a result, the striking reaction force is cushioned, so that low-vibration impact tool can be realized.

According to this invention, with the construction in which the first and second elastic members are arranged in tandem in the axial direction of the tool bit, compared with the construction in which they are arranged in parallel, the size can be reduced in a direction (radial direction) transverse to the axial direction of the tool bit.

According to a further embodiment of the impact tool of the invention, the impact tool further includes a striking element that linearly moves to linearly drive the tool bit, and a cylinder that houses the striking element. Further, the cylinder receives a force acting upon the second elastic member.

According to this invention, with the construction in which the cylinder receives a force acting upon the second elastic member, the second elastic member can be held in noncontact with the housing which forms the tool body. Specifically, with the construction in which the second elastic member is mounted to the cylinder, the second elastic member can be first mounted to the cylinder and then mounted to the housing. Therefore, compared with a construction in which the second elastic member is directly mounted to the housing, mounting of the second elastic member can be facilitated, so that ease of mounting can be enhanced.

According to a further embodiment of the impact tool of the invention, the impact tool further includes a striking element that linearly moves to linearly drive the tool bit, and a cylinder that houses the striking element, and the reaction force transmitting member comprises a cylindrical member. Further, the cylindrical member and the first elastic member are arranged in parallel such that the first elastic member is disposed inward of the cylindrical member in a radial direction of the cylinder, in a predetermined region on the cylinder in the axial direction of the tool bit.

In a construction in which the cylindrical member in the form of the reaction force transmitting member is fitted on the cylinder, the cylinder and the cylindrical member are provided with respective air vents for air supply and exhaust which provide communication between a cylinder inner space formed in front of the striking element and the outside. In this case, it must be constructed such that the air vent of the cylinder and the air vent of the cylindrical member are normally aligned with each other. In this invention, however, with the construction in which the first elastic member is disposed between the cylinder and the cylindrical member, a clearance for installing the first elastic member is provided between the cylinder and the cylindrical member, so that the air vent of the cylinder and the air vent of the cylindrical member communicate with each other through the clearance. Therefore, an additional structure for aligning the air vent of the cylinder and the air vent of the cylindrical member can be dispensed with.

According to a further embodiment of the impact tool of the invention, the impact tool further includes a striking element that linearly moves to linearly drive the tool bit, and a cylinder that houses the striking element. The reaction force transmitting member comprises a cylindrical member that is slidably fitted on the cylinder. Further, the cylindrical member has a passage that provides communication between a cylinder inner space formed in front of the striking element and the outside, and a nonreturn valve that allows air flow from the cylinder inner space to the outside through the passage and blocks air flow in the opposite direction. When the tool bit is pressed against the workpiece by the user and the cylindrical member is placed in a predetermined working position, the passage is closed by the cylinder so that the nonreturn valve is deactivated, and when the tool bit pressed against the workpiece is released and the cylindrical member is moved forward to an initial position by the biasing force of the first elastic member, the cylinder no longer closes the passage so that the nonreturn valve is allowed to activate.

According to this invention, when the tool bit is not pressed against the workpiece, the nonreturn valve is allowed to activate. In this state, when the striking element moves forward, air within the cylinder inner space in front of the striking element is discharged to the outside through the passage and the nonreturn valve. Thereafter, when the striking element is going to move rearward, the nonreturn valve blocks inflow of outside air into the cylinder inner space, so that negative pressure is caused in the cylinder inner space. As a result, the striking element is held in the forward position, so that idle driving is prevented. On the other hand, during actual operation in which the impact tool performs an operation with the tool bit being pressed against the workpiece, the nonreturn valve is deactivated. Therefore, unnecessary movement of the nonreturn valve can be reduced, so that durability of the nonreturn valve can be improved.

According to this invention, an effective technique for realizing size reduction while providing an effect of cushioning a striking reaction force caused during operation, is provided in an impact tool. Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
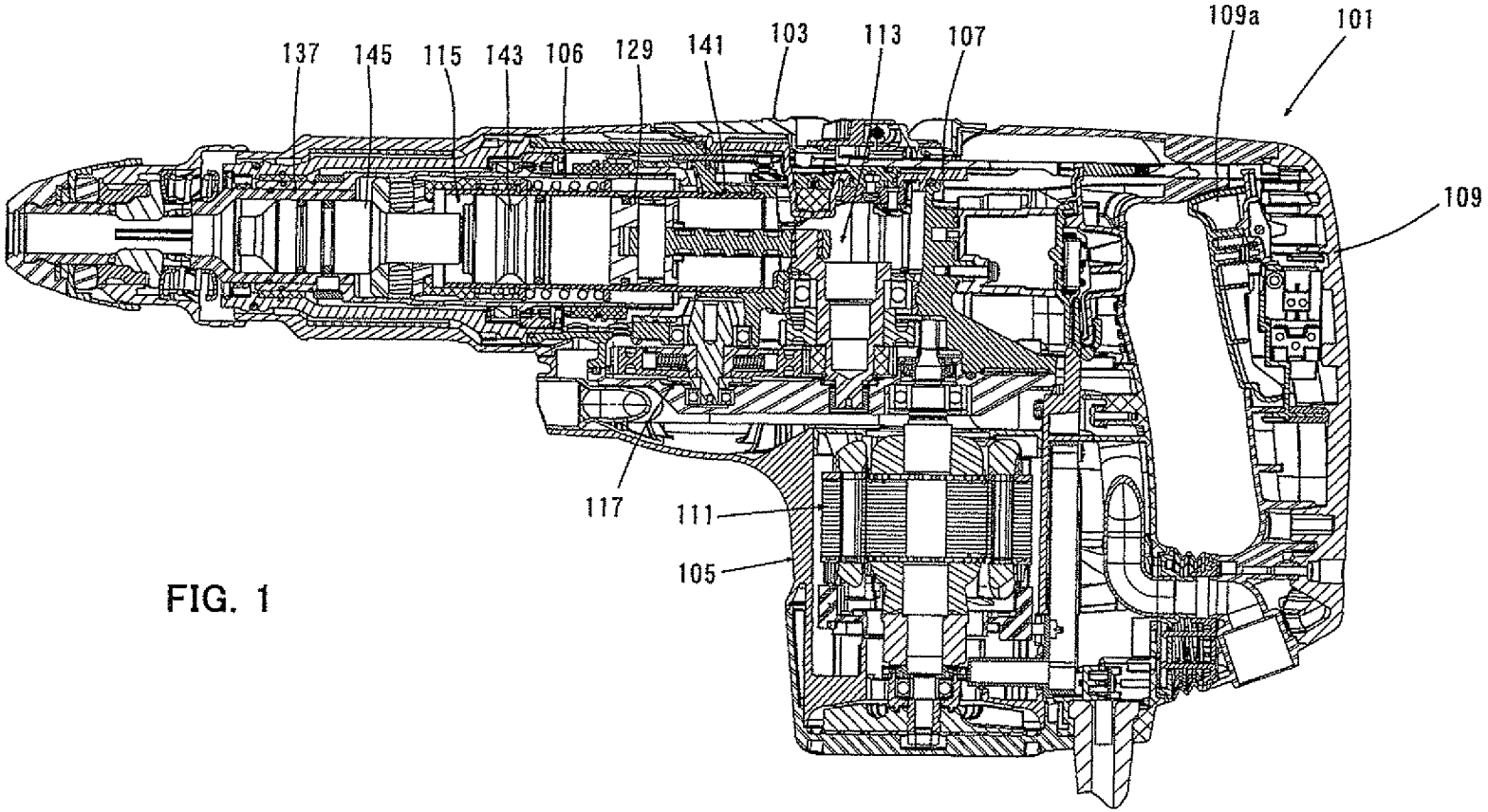
FIG. 1 is a sectional side view schematically showing an entire hammer drill according to an embodiment of this invention.

An embodiment of the invention is now described with reference to FIGS. 1 to 4. In this embodiment, an electric hammer drill is explained as a representative embodiment of an impact tool according to the invention. As shown in FIG. 1, a hammer drill 101 of this embodiment mainly includes a body 103 that forms an outer shell of the hammer drill 101, a hammer bit 119 (see FIGS. 2 and 3) detachably coupled to a tip end region (on the left as viewed in FIG. 1) of the body 103 via a tool holder 137, and a handgrip 109 that is connected to the body 103 on the side opposite the hammer bit 119 and designed to be held by a user. The body 103 and the hammer bit 119 are features that correspond to the "tool body" and the "tool bit", respectively, according to the invention. The hammer bit 119 is held by the tool holder 137 such that it is allowed to reciprocate with respect to the tool holder 137 in its axial direction and prevented from rotating with respect to the tool holder 137 in its circumferential direction. In the present embodiment, for the sake of convenience of explanation, the side of the hammer bit 119 is taken as the front and the side of the handgrip 109 as the rear.

The body 103 includes a motor housing 105 that houses a driving motor 111, and a gear housing 107 that includes a barrel 106 and houses a motion converting mechanism 113, a striking mechanism 115 and a power transmitting mechanism 117. The driving motor 111 is disposed such that its axis of rotation runs in a vertical direction substantially perpendicular to the longitudinal direction of the body 103 (the axial direction of the hammer bit 119). Rotating power of the driving motor 111 is appropriately converted into linear motion by the motion converting mechanism 113 and then transmitted to the striking mechanism 115. As a result, an impact force is generated in the axial direction of the hammer bit 119 via the striking mechanism 115. The motion converting mechanism 113 and the striking mechanism 115 form a striking mechanism part. Further, the speed of the rotating power of the driving motor 111 is appropriately reduced by the power transmitting mechanism 117 and then transmitted to the hammer bit 119 via the tool holder 137, so that the hammer bit 119 is caused to rotate in its circumferential direction. The driving motor 111 is driven when a user depresses a trigger 109*a* disposed on the handgrip 109.

The motion converting mechanism 113 mainly includes a crank mechanism. The crank mechanism is constructed such that a driving element in the form of a piston 129 forming a final movable member of the crank mechanism linearly moves in the axial direction of the hammer bit within a cylinder 141 when the crank mechanism is rotationally driven by the driving motor 111. The power transmitting mechanism 117 mainly includes a gear speed reducing mechanism comprising a plurality of gears. The power transmitting mechanism 117 transmits the rotating force of the driving motor 111 to the tool holder 137, so that the tool holder 137 is caused to rotate in a vertical plane and thus the hammer bit 119 held by the tool holder 137 rotates, The constructions of the motion converting mechanism 113 and the power transmitting mechanism 117 are well-known in the art and therefore they are not described in further detail.

Figure 2:
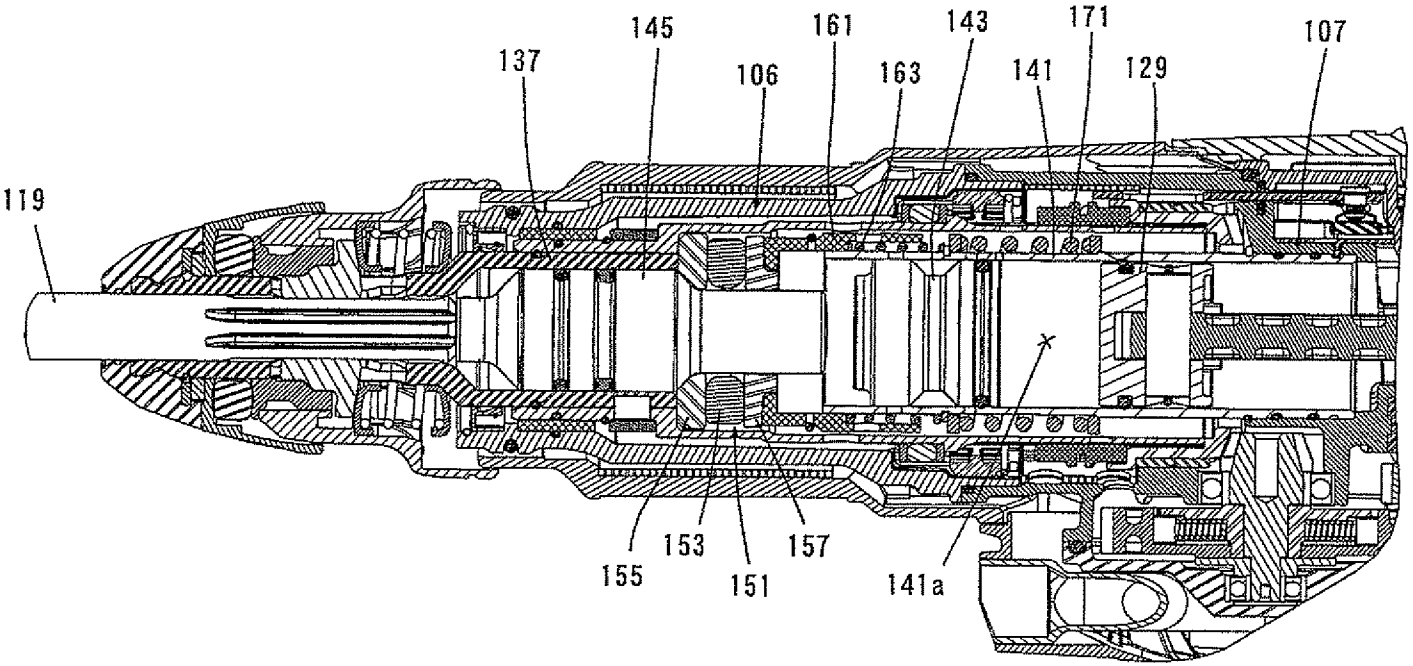
FIG. 2 is an enlarged sectional view showing an essential part of the hammer drill, under unloaded conditions in which a hammer bit is not pressed against a workpiece.
Figure 3:
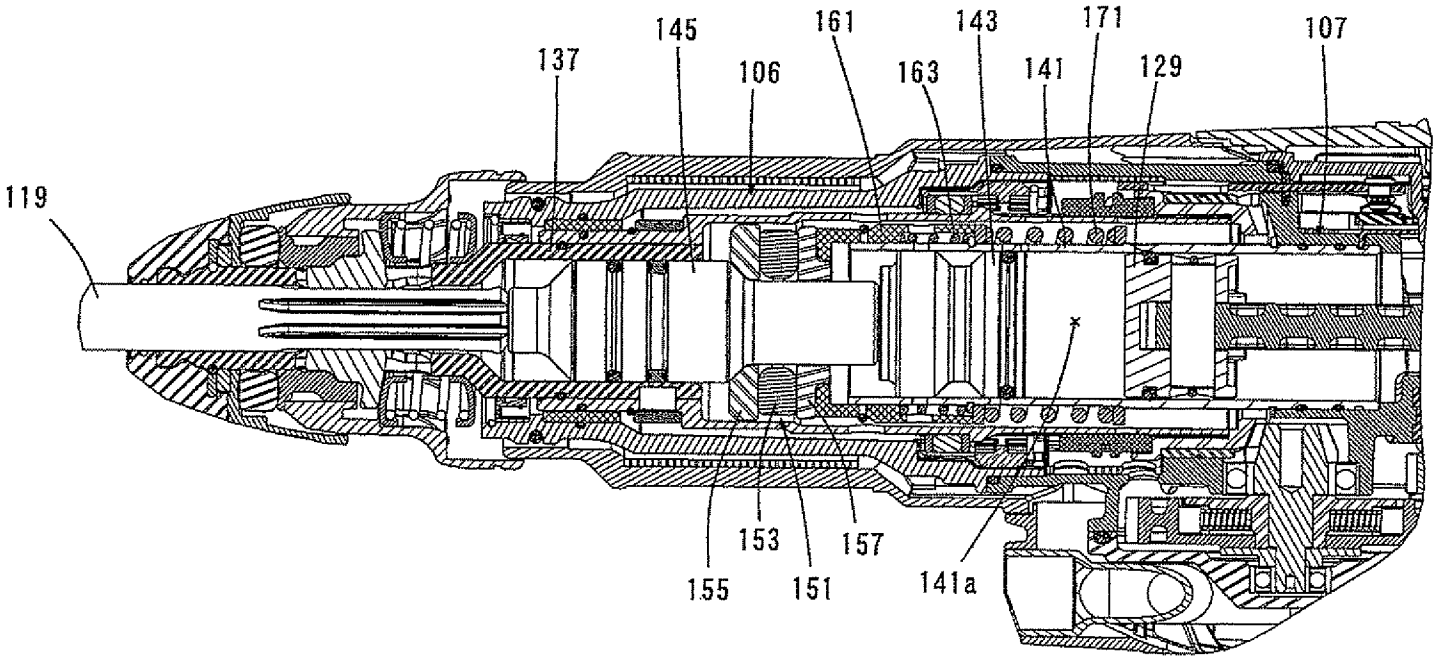
FIG. 3 is an enlarged sectional view showing the essential part of the hammer drill, under loaded conditions in which the hammer bit is pressed against a workpiece.

As shown in FIGS. 2 and 3, the striking mechanism 115 includes a striking element in the form of a striker 143 that is slidably disposed within the bore of the cylinder 141, and an intermediate element in the form of an impact bolt 145 that is slidably disposed within the tool holder 137 and transmits the kinetic energy of the striker 143 to the hammer bit 119. An air chamber 141*a* is defined between the piston 129 and the striker 143 within the cylinder 141. The striker 143 is driven via the action of an air spring (pressure fluctuations) of the air chamber 141*a* of the cylinder 141 which is caused by sliding movement of the piston 129. The striker 143 then collides with (strikes) the intermediate element in the form of the impact bolt 145 that is slidably disposed within the tool holder 137 and transmits the striking force to the hammer bit 119 via the impact bolt 145. The impact bolt 145 and the hammer bit 119 form a hammer actuating member. Further, the cylinder 141 is housed within the barrel 106 of the gear housing 107 and held by a front end region of the gear housing 107.

In the hammer drill 101 constructed as described above, when the driving motor 111 is driven, a striking force is applied to the hammer bit 119 in the axial direction from the motion converting mechanism 113 via the striking mechanism 115, and a rotating force is applied to the hammer bit 119 in the circumferential direction via the power transmitting mechanism 117. Thus, the hammer bit 119 held by a bit holding device 104 performs a hammering movement in the axial direction and a drilling movement in the circumferential direction, so that a hammer drill operation (drilling) is performed on a workpiece (concrete) which is not shown. Further, the hammer drill 101 can be appropriately switched between mode of hammer drill operation by hammering movement and drilling movement in the circumferential direction as described above and mode of hammering operation in which only a striking force in the axial direction is applied to the hammer bit 119. However, this is not directly related to the invention, and therefore its detailed description is omitted.

In the hammer drill 101, during operation, when the hammer bit 119 is pressed against the workpiece by the user's pressing force applied forward to the body 103, the impact bolt 145 is pushed rearward (toward the piston 129) together with the hammer bit 119 and comes into contact with a body-side member. As a result, the body 103 is positioned with respect to the workpiece. In this embodiment, such positioning is effected by a compression coil spring 171 for cushioning a reaction force, via a positioning member 151 and a slide sleeve 161 for prevention of idle driving. The slide sleeve 161 and the compression coil spring 171 are features that correspond to the "reaction force transmitting member" and the "second elastic member", respectively, according to this invention.

The positioning member 151 is a unit part including a rubber ring 153, a front-side hard metal washer 155 joined to the axial front side of the rubber ring 153, and a rear-side hard metal washer 157 joined to the axial rear side of the rubber ring 153. The positioning member 151 is loosely fitted onto a small-diameter portion 145*b* of the impact bolt 145. The impact bolt 145 has a stepped, cylindrical form having a large-diameter portion 145*a* that is slidably fitted in the cylindrical portion of the tool holder 137 and a small-diameter portion 145*b* formed on the rear side of the large-diameter portion 145*a*, The impact bolt 145 has a tapered portion 145*c* formed between the outer circumferential surface of the large-diameter portion 145*a* and the outer circumferential surface of the small-diameter portion 145*b*.

The slide sleeve 161 is a cylindrical member having a stepped bore formed by a small-diameter front portion and a large-diameter rear portion in the longitudinal direction. The bore small-diameter region of the slide sleeve 161 is fitted on a front end outer surface of the cylinder 141 and can slide in the axial direction of the hammer bit. A predetermined clearance C is provided between a bore large-diameter region of the slide sleeve 161 and an outer surface region of the cylinder. A sleeve biasing spring (coil spring) 163 is disposed in the clearance C. The sleeve biasing spring 163 constantly biases the slide sleeve 161 forward, and an axial rear end of the sleeve biasing spring 163 is held in contact with a retaining ring 164 fixed on the outer surface of the cylinder 141, and an axial front end of the sleeve biasing spring 163 is held in contact with a stepped part 161*a* between the bore large-diameter region and the bore small-diameter region of the slide sleeve 161. Thus, a front end of the slide sleeve 161 biased forward by the sleeve biasing spring 163 is held in contact with the rear metal washer 157 of the positioning member 151. The sleeve biasing spring 163 is a feature that corresponds to the "first elastic member" according to this invention.

The compression coil spring 171 for cushioning a reaction force is mounted on the cylinder 141 via front and rear spring receiving rings 173, 175. The front spring receiving ring 173 is fitted on the cylinder 141 and held in contact with a rear surface of the retaining ring 164 by the spring force of the compression coil spring 171, so that the front spring receiving ring 173 is prevented from moving further forward. The rear spring receiving ring 175 is fitted on the cylinder 141 and held in contact with a stepped part 141*c* formed on the outer surface of the cylinder 141, so that the rear spring receiving ring 175 is prevented from moving further rearward. The compression coil spring 171 is elastically mounted in a pre-compressed state between the front spring receiving ring 173 and the rear spring receiving ring 175. At this time, the initial load of the compression coil spring 171 is set to be larger than the pressing force of an ordinary user pressing the hammer bit 119 against the workpiece. Further, the above-described sleeve biasing spring 163 is also mounted in a pre-compressed state, but its initial load is smaller than the compression coil spring 171. In this embodiment, the initial load of the compression coil spring 171 is set to be 20 to 30 kgf, and the initial load of the sleeve biasing spring 163 is set to be 3 to 5 kgf. Further, the front spring receiving ring 173 has a larger diameter than the retaining ring 164, and an outer region of the front spring receiving ring 173 juts radially outward of the retaining ring 164.

Figure 4:
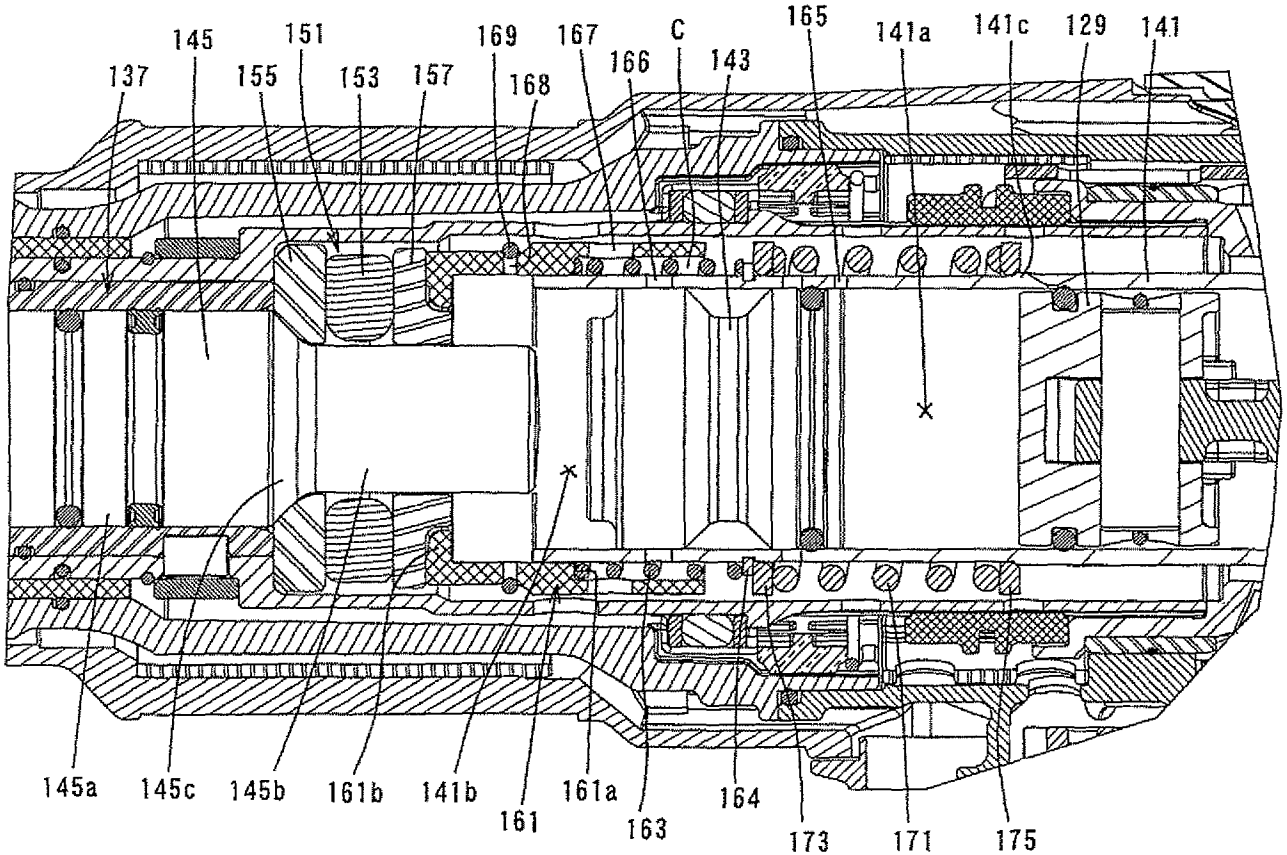
FIG. 4 is an enlarged sectional view showing a slide sleeve mechanism part and a reaction force cushioning mechanism part.

Under unloaded conditions in which the hammer bit 119 is not pressed against the workpiece, as shown in FIGS. 2 and 4, the slide sleeve 161 is moved forward to a front end position by the biasing force of the sleeve biasing spring 163. This front end position is defined as an initial position. In this initial position, the rear end surface of the slide sleeve 161 is not in contact with the front spring receiving ring 173 for the reaction-force cushioning compression coil spring 171. When the hammer bit 119 is pressed against the workpiece and moved rearward, the slide sleeve 161 is pushed rearward together with the hammer bit 119, the impact bolt 145 and the positioning member 151, and the rear end surface of the slide sleeve 161 comes into contact with the front surface of the outer region of the front spring receiving ring 173. Therefore, the user's pressing force of pressing the hammer bit 119 against the workpiece is received by the compression coil spring 171 and further by the cylinder 141 via the rear spring receiving ring 175. Thus, the body 103 is positioned with respect to the workpiece. Specifically, in this embodiment, when the user presses the hammer bit 119 against the workpiece, the body 103 is positioned by the compression coil spring 171 via the positioning member 151 and the slide sleeve 161. The position at which the rear end surface of the slide sleeve 161 contacts the front spring receiving ring 173 corresponds to the "predetermined working position" according to this invention. Further, with the construction that the initial load of the compression coil spring 171 is larger than the user's pressing force of pressing the hammer bit 119 against the workpiece, the compression coil spring 171 is not compressed by the user's pressing force when the body 103 is positioned. This state corresponds to the "incompressible state" in this invention.

The air chamber 141*a* for driving the striker 143 by the action of air spring communicates with the outside via a first air vent 165 which is formed in the cylinder 141 for prevention of idle driving. Under unloaded conditions in which the hammer bit 119 is not pressed against the workpiece, or when the impact bolt 145 is not pushed in rearward (rightward as viewed in FIGS. 2 and 4), the striker 143 is allowed to move to a front position to open the first air vent 165. On the other hand, under loaded conditions in which the hammer bit 119 is pressed against the workpiece, the impact bolt 145 is retracted and thus the striker 143 is pushed by the impact bolt 145 and moves to a rear position to close the first air vent 165 (see FIG. 3).

Thus, the first air vent 165 of the air chamber 141*a* is opened and closed by the striker 143. The action of the air spring is disabled when the first air vent 165 is opened, while it is enabled when the first air vent 165 is closed.

A closed front air chamber 141*b* is formed in front of the striker 143 on the side opposite the air chamber 141*a* and surrounded by the striker 143, the cylinder 141, the slide sleeve 161, the positioning member 151 and the impact bolt 145. The front air chamber 141*b* communicates with the outside via the second air vent 166 which is formed in the cylinder 141 for air supply and exhaust and via the third air vent 167 which is formed in the slide sleeve 161. Opening and closing of the second air vent 166 for air supply and exhaust are controlled by the position of the striker 143. Specifically, during operation of the hammer drill 101, when the striker 143 is situated rearward of a predetermined reference position (substantially near to the impact bolt 145), the front air chamber 141*b* communicates with the outside via the second air vent 166 and the third air vent 167, so that air supply and exhaust of the front air chamber 141*b* are allowed. On the other hand, when the striker 143 is moved forward past the reference position, the communication between the front air chamber 141*b* and the outside is interrupted, so that the air supply and exhaust of the front air chamber 141*b* are prohibited. As a result, the movement of the striker 143 is delayed with respect to the movement of the piston 129. Further, the second air vent 166 and the third air vent 167 communicate with each other through the clearance C between the outer surface of the cylinder 141 and the bore large-diameter region of the slide sleeve 161.

Further, a fourth air vent 168 and an O-ring 169 are provided in the front end region (bore small-diameter region) of the slide sleeve 161. The fourth air vent 168 is provided for prevention of idle driving and provides communication between the inside and outside of the front air chamber 141*b*. The O-ring 169 closes the fourth air vent 168 from the outer surface of the slide sleeve 161. The O-ring 169 allows air flow from the front air chamber 141*b* to the outside through the fourth air vent 168 and blocks air flow in the opposite direction. The fourth air vent 168 is formed in a position such that it faces the front air chamber 141*b* under unloaded conditions in which the hammer bit 119 is not pressed against the workpiece, while it is closed by the outer surface of the cylinder 141 when the slide sleeve 161 is moved rearward against the biasing force of the sleeve biasing spring 163 under loaded conditions in which the hammer bit 119 is pressed against the workpiece. The front air chamber 141*b*, the fourth air vent 168 and the O-ring 169 are features that correspond to the "cylinder inner space", the "passage" and the "nonreturn valve", respectively, according to this invention.

Operation of the hammer drill 101 constructed as described above is now explained. When the driving motor 111 is driven, the piston 129 of the crank mechanism which forms the motion converting mechanism 113 is caused to linearly slide within the cylinder 141. At this time, under unloaded conditions in which the hammer bit 119 is not pressed against the workpiece, as shown in FIG. 2, the impact bolt 145 is in the forward position. As a result, the striker 143 is moved to its forward position to open the first air vent 165. Further, under the unloaded conditions, the slide sleeve 161 is pushed forward by the sleeve biasing spring 163 and the fourth air vent 168 faces the front air chamber 141*b*. Therefore, when the striker 143 is moved forward past the position of the second air vent 166, air within the front air chamber 141*b* is discharged to the outside through the fourth air vent 168 and the O-ring 169, In this state, when the piston 129 moves rearward, outside air is led into the air chamber 141*a* through the first air vent 165, but in the front air chamber 141*b*, the fourth air vent 168 is closed by the O-ring 169, so that outside air is not led into the front air chamber 141*b*. Therefore, the striker 143 is held in the forward position without being sucked up toward the piston 129 by negative pressure caused in the front air chamber 141*b*. Thereafter, even if the piston 129 is driven, the hammer bit 119 is prevented from idle driving.

On the other hand, under loaded conditions in which the hammer bit 119 is pressed against the workpiece, as shown in FIG. 3, the impact bolt 145 is pushed rearward together with the hammer bit 119 and in turn pushes the positioning member 151 and the slide sleeve 161 against the biasing force of the sleeve biasing spring 163. Then the rear end surface of the slide sleeve 161 comes in contact with the front surface of the outer region of the front spring receiving ring 173 for the compression coil spring 171. Thus, the body 103 is positioned with respect to the workpiece. In this state, the striker 143 is pushed rearward by the impact bolt 145 and closes the first air vent 165. When the piston 129 is moved forward in this state, the striker 143 moves linearly forward within the cylinder 141 and collides with (strikes) the impact bolt 145 by the action of the air spring function of the air chamber 141*a*. The kinetic energy of the striker 143 which is caused by the collision with the impact bolt 145 is transmitted to the hammer bit 119. Thus, the hammer bit 119 performs an operation on the workpiece by striking movement in its axial direction. Further, after collision with the impact bolt 145, the striker 143 is moved rearward by a rebound caused by striking the impact bolt 145, and by a sucking force (negative pressure) caused in the air chamber 141*a* by rearward movement of the piston 129. Thereafter, the above-described movement is repeated.

During the above-described operation, when the hammer bit 119 performs striking movement on the workpiece and the hammer bit 119 is caused to rebound by the reaction force from the workpiece, a force caused by this rebound, or striking reaction force moves the hammer bit 119, the impact bolt 145, the positioning member 151 and the slide sleeve 161 rearward and elastically deforms (compresses) the compression coil spring 171. Specifically, the striking reaction force caused by rebound of the hammer bit 119 is efficiently cushioned by elastic deformation of the compression coil spring 171, so that transmission of the reaction force to the body 103 is reduced. At this time, a flange part 161*b* which extends radially inward from the slide sleeve 161 faces the front end surface of the cylinder 141 with a predetermined clearance therebetween and can come into contact with it, so that the maximum retracted position of the slide sleeve 161 is defined. Therefore, the reaction force cushioning action of the compression coil spring 171 is effected within the range of the above-mentioned clearance.

As described above, according to this embodiment, by provision of the mechanism of cushioning the striking reaction force from the hammer bit 119 by the compression coil spring 171 via the slide sleeve 161 for prevention of idle driving, an idle driving prevention effect and a vibration reducing effect can be obtained.

Further, according to this embodiment, the compression coil spring 171 is mounted on the cylinder 141 via the front and rear spring receiving rings 173, 175. Therefore, the cylinder 141 and the compression coil spring 171 are assembled into one piece, so that the cylinder 141 and the compression coil spring 171 can be mounted and removed from the gear housing 107 as one piece.

Thus, ease of mounting or repairing can be enhanced.

Further, in this embodiment, during operation in which the hammer bit 119 is pressed against the workpiece and the slide sleeve 161 is pushed rearward, the fourth air vent 168 is situated in a position to face the outer surface of the cylinder 141 and closed by the outer surface of the cylinder 141. Specifically, during actual operation in which the hammer drill 101 performs an operation, the nonreturn valve in the form of the O-ring 169 is held at a standstill (deactivated). With this construction, unnecessary movement of the O-ring 169 can be reduced during actual operation, so that durability of the O-ring 169 can be improved.

Further, according to this embodiment, the clearance C is provided between the outer surface of the cylinder 141 and the inner surface of the slide sleeve 161, and the second air vent 166 of the cylinder 161 and the third air vent 167 of the slide sleeve 161 communicate with each other through the clearance C. With this construction, reliability of air supply and exhaust can be enhanced without need of taking measures to align the second air vent 166 and the third air vent 167. Further, with the construction in which the sleeve biasing spring 163 is arranged in parallel within the clearance C provided between the outer surface of the cylinder 141 and the inner surface of the slide sleeve 161, size increase of the body 103 in the longitudinal direction can be avoided.

Further, according to this embodiment, with the construction in which the sleeve biasing spring 163 and the compression coil spring 171 are arranged in tandem, compared with a construction in which they are arranged in parallel, the size of the body 103 can be reduced in the radial direction. Further, with the construction in which the outside diameter of the slide sleeve 161 is substantially equal to the outside diameter of the compression coil spring 171, although the slide sleeve 161 and the sleeve biasing spring 163 are arranged in parallel, size increase of the body 103 in the radial direction can be avoided.

In the above-described embodiment, as a representative example of the impact tool, the hammer drill 101 was described in which the hammer bit 119 can be switched between mode of hammering operation by hammering movement of the hammer bit 119 and mode of hammer drill operation by hammering movement in the axial direction and drilling movement in the circumferential direction. However, the invention can also be applied to an electric hammer in which the hammer bit 119 performs only hammering movement in its axial direction.

According to the aspect of the invention, following features can be provided.

(1)

"The impact tool as defined in any one of claims 1 to 4, wherein the cylinder includes a front spring receiving ring that is prevented from moving forward and a rear spring receiving ring that is prevented from moving rearward, and the second elastic member comprises a compression coil spring and is elastically disposed in a pre-compressed state between the front spring receiving ring and the rear spring receiving ring."

(2)

"The impact tool as defined in (1), wherein the cylinder includes a retaining ring which is held in contact with the front spring receiving ring and prevents the front spring receiving ring from moving forward, while receiving a rear end of the first elastic member, and the front spring receiving ring has a larger diameter than the retaining ring, and when the user presses the tool bit against the workpiece, a rear end surface of the reaction force transmitting member contacts a front surface of an outer region of the front spring receiving ring."

DESCRIPTION OF NUMERALS

101 hammer drill (impact tool)
103 body
105 motor housing
106 barrel
107 gear housing
109 handgrip
109*a* trigger
111 driving motor
113 motion converting mechanism
115 striking mechanism
117 power transmitting mechanism
119 hammer bit (tool bit)
129 piston
137 tool holder
141 cylinder
141*a* air chamber
141*b* front air chamber (cylinder inner space)
141*c* stepped part
143 striker (striking element)
145 impact bolt (intermediate element)
145*a* large-diameter portion
145*b* small-diameter portion
145*c* tapered portion
151 positioning member
153 rubber ring
155 front metal washer
157 rear metal washer

161 slide sleeve (reaction force transmitting member)
161*a* stepped part
161*b* flange part
163 sleeve biasing spring (first elastic member)
164 retaining ring
165 first air vent
166 second air vent
167 third air vent
168 fourth air vent (passage)
169 O-ring (nonreturn valve)
171 compression coil spring (second elastic member)
173 front spring receiving ring
175 rear spring receiving ring
C clearance

What we claim is:

1. An impact tool which performs a predetermined operation on a workpiece at least by an axial linear movement of a tool bit which is mounted in a front end region of a tool body, the impact tool comprising:

a reaction force transmitting member configured to be movable in an axial direction of the tool bit and to be moved rearward, in a direction away from the tool bit, by receiving a striking reaction force caused when the tool bit strikes the workpiece;

a first elastic member that biases the reaction force transmitting member forward; and a second elastic member configured to be pushed by the reaction force transmitting member and compressively deform, thereby cushioning the striking reaction force, when the reaction force transmitting member moves rearward by receiving the striking reaction force, wherein a first initial load of the first elastic member is set to be smaller than a second initial load of the second elastic member, when the tool bit is pressed against the workpiece, the reaction force transmitting member is pushed by the tool bit and compresses the first elastic member as the second elastic member remains uncompressed relative to the second initial load, so that the reaction force transmitting member is placed in a predetermined working position in the longitudinal direction, and when the reaction force transmitting member receives the striking reaction force in the working position, the reaction force transmitting member moves rearward in the axial direction of the tool bit and compressively deforms the second elastic member, thereby cushioning the striking reaction force, and the first and second elastic members are arranged in tandem in the axial direction of the tool bit.

2. The impact tool as defined in claim 1, further comprising:

a striking element configured to move linearly to linearly drive the tool bit; and a cylinder that houses the striking element, wherein the cylinder is configured to receive a force acting upon the second elastic member.

3. The impact tool as defined in claim 1, further comprising:

a striking element configured to move linearly to linearly drive the tool bit; and a cylinder that houses the striking element, wherein the reaction force transmitting member comprises a cylindrical member, and the cylindrical member and the first elastic member are arranged in parallel such that the first elastic member is disposed radially inward of the cylindrical member in a predetermined region on the cylinder in the axial direction of the tool bit.

4. The impact tool as defined in claim 1, further comprising:

a striking element configured to move linearly to linearly drive the tool bit; and a cylinder that houses the striking element, wherein the reaction force transmitting member comprises a cylindrical member that is slidably fitted on the cylinder, the cylindrical member having a passage configured to provide communication between a cylinder inner space formed in front of the striking element and an outside space, and a nonreturn valve configured to allow air flow from the cylinder inner space to the outside space through the passage and block air flow in an opposite direction, when the tool bit is pressed against the workpiece and the cylindrical member is placed in a predetermined working position, the passage is closed by the cylinder so that the nonreturn valve is deactivated, and when the tool bit pressed against the workpiece is released and the cylindrical member is moved forward to an initial position by the biasing force of the first elastic member, the cylinder no longer closes the passage so that the nonreturn valve is allowed to activate.

5. The impact tool as defined in claim 1, further comprising:

a striking element configured to move linearly to linearly drive the tool bit;

a cylinder that houses the striking element;

a front spring receiving ring that is prevented from moving forward relative to the cylinder; and a rear spring receiving ring that is prevented from moving rearward relative to the cylinder, wherein the second elastic member comprises a compression coil spring and is elastically disposed in a precompressed state between the front spring receiving ring and the rear spring receiving ring.

6. The impact tool as defined claim 5, wherein the cylinder includes a retaining ring held in contact with the front spring receiving ring, the retaining ring preventing the front spring receiving ring from moving forward relative to the cylinder while receiving a rear end of the first elastic member, the front spring receiving ring has a larger diameter than the retaining ring, and when the tool bit is pressed against the workpiece, a rear end surface of the reaction force transmitting member contacts a front surface of an outer region of the front spring receiving ring.

* * * * *